US005676604A

United States Patent [19]

McCormick

[11] Patent Number: 5,676,604

[45] Date of Patent: Oct. 14, 1997

[54] GOLF TRAINING DEVICE

[76] Inventor: Ronald H. McCormick, Box 96, Lloydminster, Sasktchewan, Canada, S9V 0X9

[21] Appl. No.: 677,077

[22] Filed: Jul. 9, 1996

[51] Int. Cl.[6] ..... A63B 69/36

[52] U.S. Cl. ..... 473/263; 473/279

[58] Field of Search ..... 473/261, 263, 473/264, 265, 279, 257, 258, 260

[56] References Cited

U.S. PATENT DOCUMENTS

| | | | |
|---|---|---|---|
| 1,596,919 | 8/1926 | Burgoyne et al. | 473/264 |
| 2,152,381 | 3/1939 | Harpster | 473/265 |
| 3,107,920 | 10/1963 | Strunk . | |
| 3,350,101 | 10/1967 | Bishop et al. . | |
| 3,408,076 | 10/1968 | Carboni . | |
| 3,894,739 | 7/1975 | Goldstein . | |
| 5,263,719 | 11/1993 | Bunn . | |

*Primary Examiner*—George J. Marlo

*Attorney, Agent, or Firm*—Murray E. Thrift; Adrian D. Battison

[57] ABSTRACT

A golf swing training apparatus has a flat base for supporting a tee. A target line is marked on the base, through the tee location. To guide the correct swing of a driver, a foam block is positioned on the base on the side of the target line opposite the golfer. The block normally converges towards the target line on the back side of the tee to guide the club head along an inside out trajectory as it approaches the ball. To accommodate the proper backswing, which should follow an inside out trajectory, the guide block is pivotally mounted to pivot about an upright axis to one side of the tee on the base and is resiliently biased to its normal position so that the backswing will swing the guide block out of the way during the backswing.

8 Claims, 2 Drawing Sheets

GOLF TRAINING DEVICE

FIELD OF THE INVENTION

The present invention relates to golf training and more particularly to an apparatus for training the proper swing of a golf driver.

BACKGROUND

The majority of amateur golfers suffer from a tendency to slice or fade the ball. The chief cause of this is a tendency to swing the club towards the ball from the outside, which is the opposite of what is needed to hit the ball straight. Those who slice the ball take the club back inside the target line on the backswing and then bring it back down outside the target line on the downswing, thus cutting across the ball and imparting a slice spin to the ball, causing it to curve right for a right-handed golfer. This is the opposite of the desired club swing.

The present invention proposes a device that is intended to assist a golfer in eliminating this tendency.

SUMMARY

According to the present invention there is provided a golf swing training apparatus comprising:

a base;

tee marking means on the base marking a tee location;

target line means on the base marking a target line through the tee location and extending at least to a back swing side of the tee location;

a club head guide having an upright guide face positioned on one side of the target line, the guide face having a normal position converging towards the target line on the back swing side of the tee location from a position spaced to one side of the tee location;

pivot means mounting the club head guide on the base for pivotal movement out of the normal position, away from the target line, about a pivot spaced to said one side of the tee location; and biasing means biasing the club head guide to the normal position.

The guide is preferably a block of foam material, mounted on a swing arm. Having the block set at an angle to the target line reinforces the desired approach to the ball from the inside. The block will, however, interfere with the desired movement of the club back along the target line on the backswing. This is needed to give good extension in the backswing. To alleviate this problem, the guide pivots out of the way on the backswing, allowing the proper movement of the club head. This also provides the golfer with a tactile and visual feedback of the proper club head motion on the backswing.

The club head guide is preferably mounted on the swing arm with a releasable fastener, for example the hook and loop fastener sold under the trademark VELCRO. Consequently, when an error occurs in the swing, the club head will hit the foam block and will dislodge it from the swing arm with no severe impact loads and no damage caused to the club, the trainer or the golfer.

That part of the base that extends along the target line and includes the tee location is preferably raised. This is conducive to a flatter, more horizontal swing plane. A flatter swing plane makes it easier to swing from the inside.

The device may be made with two tee holes to accommodate regular and jumbo size drivers.

BRIEF DESCRIPTION OF THE DRAWINGS

In the accompanying drawings, which illustrate an exemplary embodiment of the present invention.

DETAILED DESCRIPTION

Figures 1, 2, 3:
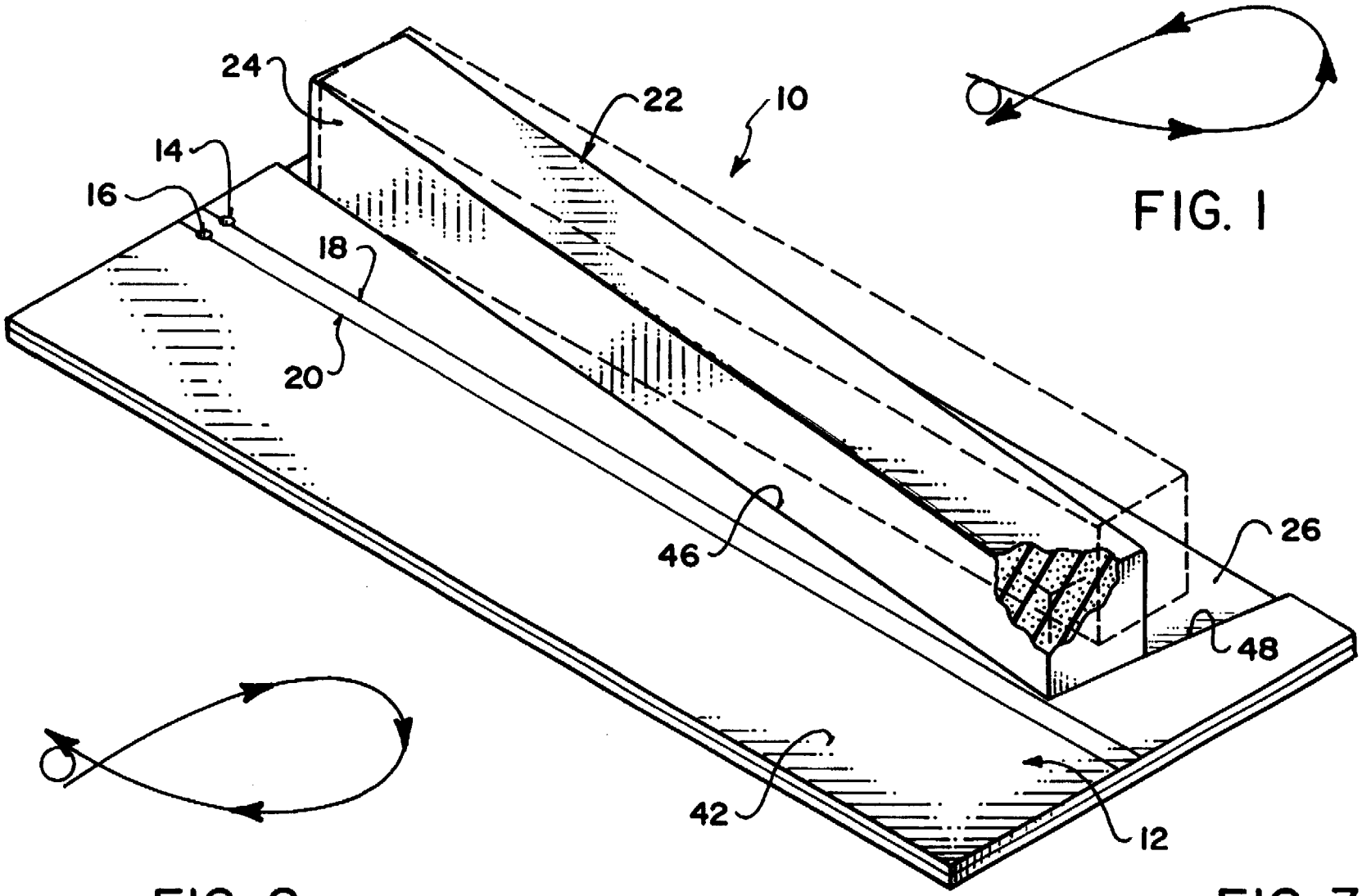
FIG. 1 is an illustration of an incorrect swing path.
FIG. 2 is an illustration like FIG. 1 showing the correct swing path.
FIG. 3 is an isometric view of the apparatus according to the present invention.

Referring to the accompanying drawings, FIG. 1 illustrates in an exaggerated way the improper club head path that leads to a swing. On the backswing, the club is taken back inside the target line and then on the downswing it is brought down outside the target line, thus cutting across the ball and imparting slice spin to the ball, causing it to curve right for a right-handed golfer.

FIG. 2 illustrates the proper club head path where the path is reversed, with the club head traveling outside the target line and then down on the inside of the target line to the ball. This will cause a squaring of the club face as it meets the ball because of the rotary motion of the swing as a whole.

Figure 4:
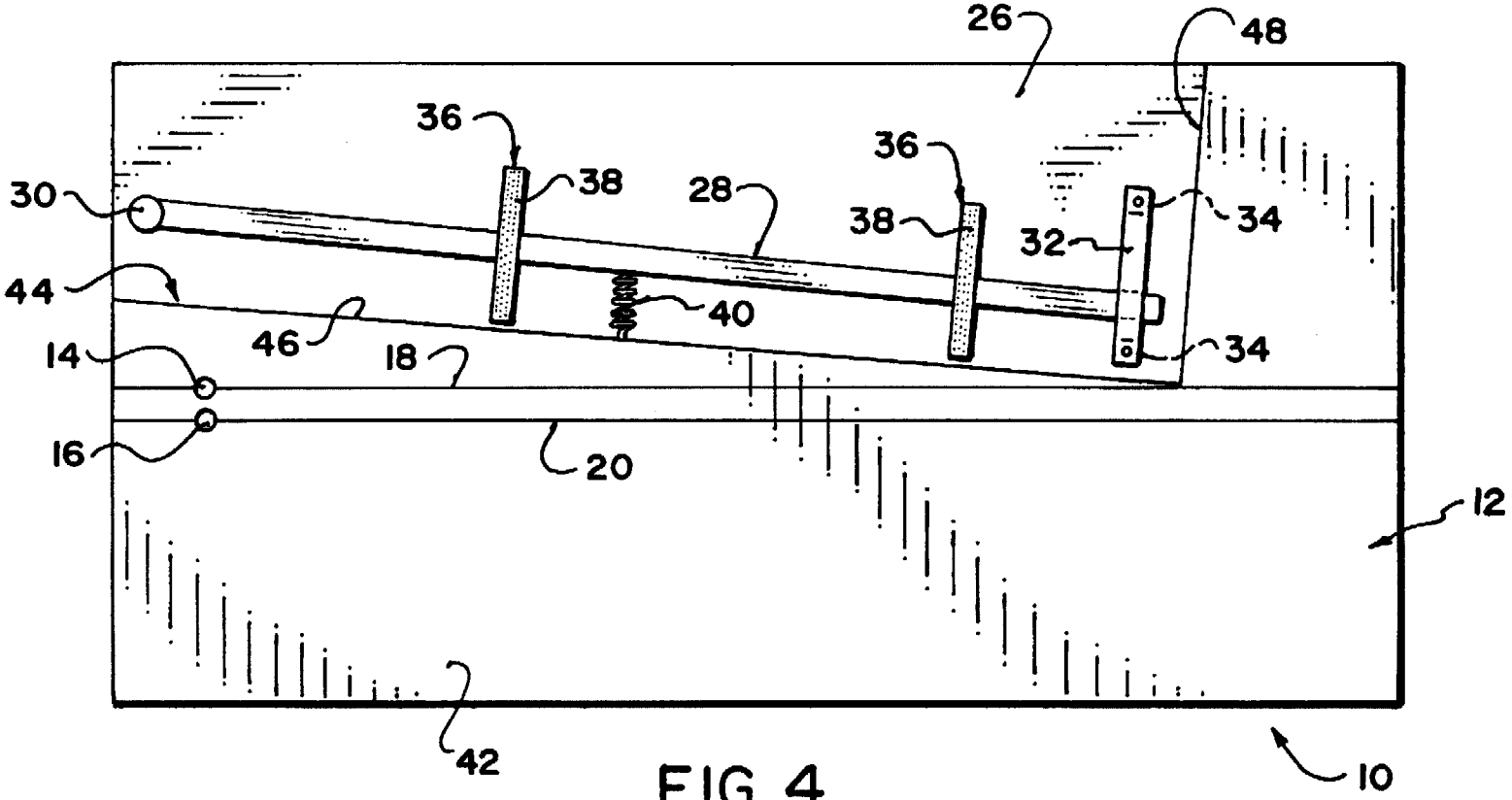
FIG. 4 is a plan view of the apparatus with the foam block removed.

The training apparatus 10 illustrated in FIGS. 3 and 4 is intended to train the proper movement of the club head. The training apparatus includes a flat base 12 with two tee holes 14 and 16 near one end to hold rubber tees. Two parallel target lines 18 and 20 extend along the top of the base through the tee locations as marked by the tee holes. The target line 18 and the associated tee hole 14 are used with standard size drivers while the target line 20 and the tee hole 16 are used with jumbo drivers.

Mounted on the base 12 is a club head guide 22. This is a rectangular block of soft, resilient foam projecting upwardly from the base. It has an upright guide face 24 positioned on one side of the target lines 18 and 20. In the normal position of the guide, the guide face converges towards the target lines 18 and 20 on the backswing side of the tee holes 14 and 16.

The base 12 includes a bottom panel 26 on which the guide 22 is mounted. The guide includes a swing arm 28 mounted on the base panel by a pivot 30 to pivot about an axis spaced to one side of the tees. The swing arm extends along the panel and at its end remote from the pivot extends under a hold-down plate 32 mounted on the bottom panel 26 by two spacers 34. The hold-down plate provides a slot in which the swing arm may slide from side to side as it pivots around the pivot 30.

Two saddles 36 are mounted on the swing arm and extend transversely across the swing arm. The upper surface of each saddle is equipped with a strip 38 of one component of a two component fastener, for example the hook and loop fastener sold under the trademark VELCRO. A spring 40 is connected to the swing arm and to the base to draw the swing arm into a normal position converging towards the target lines 18 and 20.

The base is completed with an upper panel 42 that has a notch 44 accommodating the guide 22. One edge 46 of the notch converges from the end of the panel towards the target line 18 and abuts the guide face 24 of the guide to act as a stop in the normal position of the guide. The back edge 48 of the notch extends to the side of the upper panel.

Figure 5:
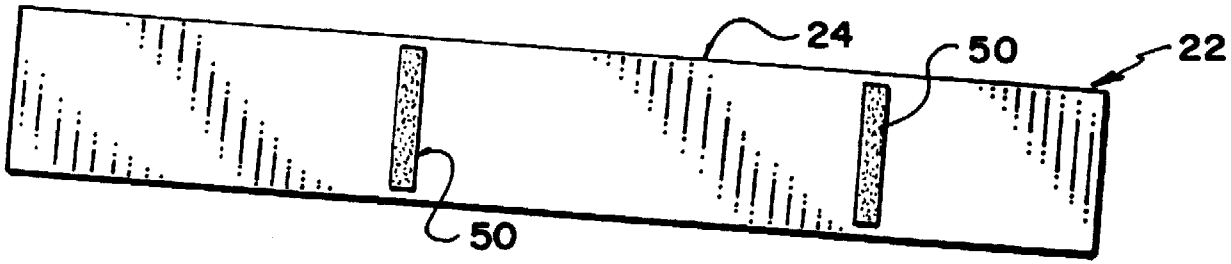
FIG. 5 is a bottom view of the block showing the releasable fasteners.

As illustrated in FIG. 5, the bottom of the foam guide block has two strips of fastener 50 for engaging the fastener 38 on the swing arm saddles for holding the guide block in place on the swing arm.

In use of the apparatus, a tee is inserted in either of the tee holes 14 and 16, the ball is addressed in the usual way with the guide block on the opposite side of the target line from the golfer. On the backswing, the club head should engage the guide 22 and swing it out of the way to the broken line position illustrated in FIG. 3. When the club head passes the block on the backswing, the guide returns to its normal position and guides the golfer in bringing the club along an inside out trajectory as it approaches the ball.

If an error in the swing occurs then the club head merely hits the foam block, dislodging it from the fasteners on the swing arm.

While one embodiment of the present invention has been described in the foregoing, it is to be understood that other embodiments are possible within the scope of the invention and are intended to be included herein. The invention is to be considered limited solely by the scope of the appended claims.

I claim:

1. A golf swing training apparatus comprising:

an elongate base;

tee marking means on the base marking a tee location adjacent one end of the base;

target line means on the base, comprising a straight target line through the tee location and extending along the base at least to a backswing side of the tee location;

a club head guide comprising an elongate block having an elongate, upright guide face extending along the base on one side of the target line, the guide face having a normal position converging towards the target line on the backswing side of the tee location from a position spaced to one side of the tee location;

pivot means mounting the club head guide on the base for pivotal movement out of the normal position, away from the target line, about an upright axis spaced to said one side of the tee location and adjacent said one end of the base; and resilient biasing means resiliently biasing the club head guide to pivot about the upright axis to the normal position.

2. A training apparatus according to claim 1 wherein the club head guide is resiliently deformable.

3. A training apparatus according to claim 2 wherein the club head guide comprises a block of foam material.

4. A training apparatus according to claim 1 including stop means engaging the club head guide in the normal position to retain the club head guide in the normal position.

5. A training apparatus according to claim 1 wherein the club head guide comprises a swing arm mounted on the base by the pivot means, a guide block and means releasably mounting the guide block on the swing arm.

6. A training apparatus according to claim 1 comprising a plurality of spaced apart tee marking means marking respective tee locations and a plurality of target lines through the respective tee locations.

7. A training apparatus according to claim 6 wherein each tee marking means comprises a tee hole for supporting a tee.

8. A training apparatus according to claim 1 wherein the base comprises a raised portion extending along the target line and including the tee location.

* * * * *